US009683579B2

(12) United States Patent
Mizuno et al.

(10) Patent No.: US 9,683,579 B2
(45) Date of Patent: Jun. 20, 2017

(54) CIRCULATOR

(75) Inventors: Norihito Mizuno, Gifu (JP); Yusuke Tanaka, Gifu (JP); Ken Hayashi, Gifu (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 284 days.

(21) Appl. No.: 13/982,183

(22) PCT Filed: Jan. 28, 2011

(86) PCT No.: PCT/JP2011/051818
§ 371 (c)(1),
(2), (4) Date: Jul. 26, 2013

(87) PCT Pub. No.: WO2012/101823
PCT Pub. Date: Aug. 2, 2012

(65) Prior Publication Data

US 2013/0309111 A1 Nov. 21, 2013

(51) Int. Cl.
*F04D 13/06* (2006.01)
*F04D 29/52* (2006.01)
(Continued)

(52) U.S. Cl.
CPC ..... *F04D 29/522* (2013.01); *F04D 13/06* (2013.01); *F04D 25/08* (2013.01); *F04D 29/526* (2013.01); *F04D 29/541* (2013.01)

(58) Field of Classification Search
CPC .... F04D 29/4226; F04D 29/52; F04D 29/522; F04D 29/526; F04D 25/08; F04D 13/06; F04D 19/002; F04D 29/541; F04D 29/64
(Continued)

(56) References Cited

U.S. PATENT DOCUMENTS 4,353,680 A * 10/1982 Hiraoka ..... F04D 29/646 415/201
4,657,483 A * 4/1987 Bede ..... 415/222
(Continued)

FOREIGN PATENT DOCUMENTS

CN 2893253 Y 4/2007
JP 61-065859 5/1986
(Continued)

OTHER PUBLICATIONS

Office Action (Examination Report under Section 18(3)) issued on Jul. 22, 2016, by the Intellectual Property Office of the United Kingdom in corresponding United Kingdom Patent Application No. GB1311020.0. (5 pages).
(Continued)

*Primary Examiner* — Dominick L Plakkoottam
*Assistant Examiner* — Connor Tremarche
(74) *Attorney, Agent, or Firm* — Buchanan Ingersoll & Rooney PC

(57) ABSTRACT

A circulator includes a main body forming an air passage, an impeller, and a motor. The main body is cylindrical, in which a discharge port is formed at one end thereof, a suction port is formed at the other end thereof, and the air passage extending from the suction port to the discharge port is formed in the inside thereof. An orifice is provided annularly along an inner periphery of the air passage to locally narrow the air passage. An impeller is disposed in a part of the air passage having been narrowed by the orifice. A motor is connected to the impeller to rotate the impeller so that the air having been sucked from the suction port is blown from the discharge port.

9 Claims, 8 Drawing Sheets

(51) Int. Cl.
*F04D 25/08* (2006.01)
*F04D 29/54* (2006.01)

(58) Field of Classification Search
USPC ..... 417/423.14
See application file for complete search history.

(56) References Cited

U.S. PATENT DOCUMENTS

| | | | | | |
|---|---|---|---|---|---|
| 4,927,324 | A * | 5/1990 | Coup | F04D 29/703 | 415/121.2 |
| 4,971,143 | A * | 11/1990 | Hogan | 165/122 | |
| 5,304,040 | A * | 4/1994 | Wang | F04D 29/646 | 248/188.2 |
| 6,994,523 | B2 * | 2/2006 | Eguchi | F04D 29/384 | 416/228 |
| 7,481,619 | B2 * | 1/2009 | Obosu | F04D 29/545 | 415/221 |
| 7,530,783 | B1 * | 5/2009 | Ediger | F04D 29/646 | 415/121.2 |
| 7,618,233 | B2 * | 11/2009 | Parker | F04D 29/164 | 415/119 |
| 9,513,021 | B2 * | 12/2016 | Kato | F04D 29/162 | |
| 2001/0036416 | A1 | 11/2001 | Obara | | |
| 2002/0015640 | A1 * | 2/2002 | Nishiyama | F01P 11/12 | 415/119 |
| 2004/0165986 | A1 | 8/2004 | Parker et al. | | |
| 2008/0101964 | A1 * | 5/2008 | Iwase | F04D 29/386 | 417/321 |

FOREIGN PATENT DOCUMENTS

| | | | |
|---|---|---|---|
| JP | 6-73627 | U | 10/1994 |
| JP | 3062702 | U | 7/1999 |
| JP | 11-257280 | | 9/1999 |
| JP | 2000-074431 | A | 3/2000 |
| JP | 2001-304189 | | 10/2001 |
| JP | 2002-061909 | A | 2/2002 |
| JP | 2002-071178 | A | 3/2002 |
| JP | 2002-147785 | A | 5/2002 |
| JP | 2003-227640 | A | 8/2003 |
| JP | 2004-225567 | A | 8/2004 |
| JP | 3104900 | U | 8/2004 |
| JP | 2010-054084 | A | 3/2010 |
| KR | 1020050029317 | A | 3/2005 |

OTHER PUBLICATIONS

Korean Office Action dated Jun. 25, 2014 issued in corresponding Korean Patent Appln. No. 10-2013-7016360, with English translation (6 pages).

Japanese Office Action (Notice of Rejection) dated Sep. 17, 2013, issued by the Japanese Patent Office in corresponding Japanese Patent Application No. 2012-554599, and partial English language translation of Office Action. (6 pages).

International Search Report (PCT/ISA/210) issued on Mar. 29, 2011, by the Japanese Patent Office as the International Searching Authority for International Application No. PCT/JP2011/051818.

Written Opinion (PCT/ISA/237) issued on Mar. 29, 2011, by the Japanese Patent Office as the International Searching Authority for International Application No. PCT/JP2011/051818.

Office Action issued on Mar. 9, 2015, by the Chinese Patent Office in corresponding Chinese Patent Application No. 201180065935.2 and an English translation of the Office Action. (9 pages).

* cited by examiner

CIRCULATOR

FIELD

The present invention relates to a circulator that forcibly agitates or circulates interior air.

BACKGROUND

Conventionally, when an air conditioning apparatus such as an air conditioner is operated in a predetermined space such as an office, variations in temperature sometimes occur in a vertical direction or a horizontal direction in the space. The variations in temperature may cause people in the space to be discomforted. In order to moderate such variations in temperature in a predetermined space, a circulator that forcibly agitates or circulates air in the space has been conventionally used.

Various types of such a circulator have been proposed in relation to the size of the space, the location to agitate or circulate air, the agitating or circulating system, the price and installation cost, and the like (for example, Patent Literatures 1 to 3). Among these circulators, a desktop or floor-placed circulator that is easily installed and inexpensive has been recently used in houses and the like, and is growing in demand. Such a desktop or floor-placed circulator has similar functions to those of conventional electrical fans. However, a difference between them is that the circulator discharges a straighter air flow as compared to the conventional fans.

There has been recently proposed a desktop or floor-placed circulator that includes a cylindrical main body and forms a straightly-extending air passage in the inside of the cylindrical main body. At the time of discharging an air flow from a discharge port, this circulator having the straightly-extending air passage generates an air flow along the air passage to enhance straightness of the discharged air and further increase the outreach distance of the blown air.

CITATION LIST

Patent Literatures

Patent Literature 1: Japanese Patent Application Laid-open No. 2000-074431

Patent Literature 2: Japanese Patent Application Laid-open No. 2002-061909

Patent Literature 3: Japanese Patent Application Laid-open No. 2003-227640

SUMMARY

Technical Problem

However, none of the above conventional circulators have ever been functionally sufficient, and there has been demanded a more functionally-enhanced circulator that provides a straighter air flow with compactness, low noise and a large amount of air.

The present invention has been achieved in view of the above-mentioned circumstances, and an object of the present invention is to provide a circulator that provides a straighter air flow with compactness, low noise and a large amount of air.

Solution to Problem

In order to solve the above-mentioned problems and achieve the object, the present invention provides a circulator comprising: a main body that is cylindrical, in which a discharge port is formed at one end thereof, a suction port is formed at the other end thereof, and an air passage extending from the suction port to the discharge port is formed in inside thereof; an orifice that is provided annularly along an inner periphery of the air passage and locally narrows the air passage; an impeller that is located in a part of the air passage having been narrowed by the orifice; and a motor that is connected to the impeller and rotates the impeller to discharge air having been sucked from the suction port out of the discharge port.

Advantageous Effects of Invention

According to the present invention, an air passage is formed in a cylindrical main body, an orifice is provided in the air passage, and an impeller is disposed in a part of the air passage having been narrowed by the orifice. Therefore, a high-speed air flow can be effectively formed. Accordingly, it is possible to provide a circulator that provides a straighter air flow, and is compact with low noise and a large amount of air.

DESCRIPTION OF EMBODIMENTS

Embodiment of a circulator according to the present invention will be described below in detail with reference to the drawings. The present invention is not limited to the embodiment.

Embodiment.

Figure 1:
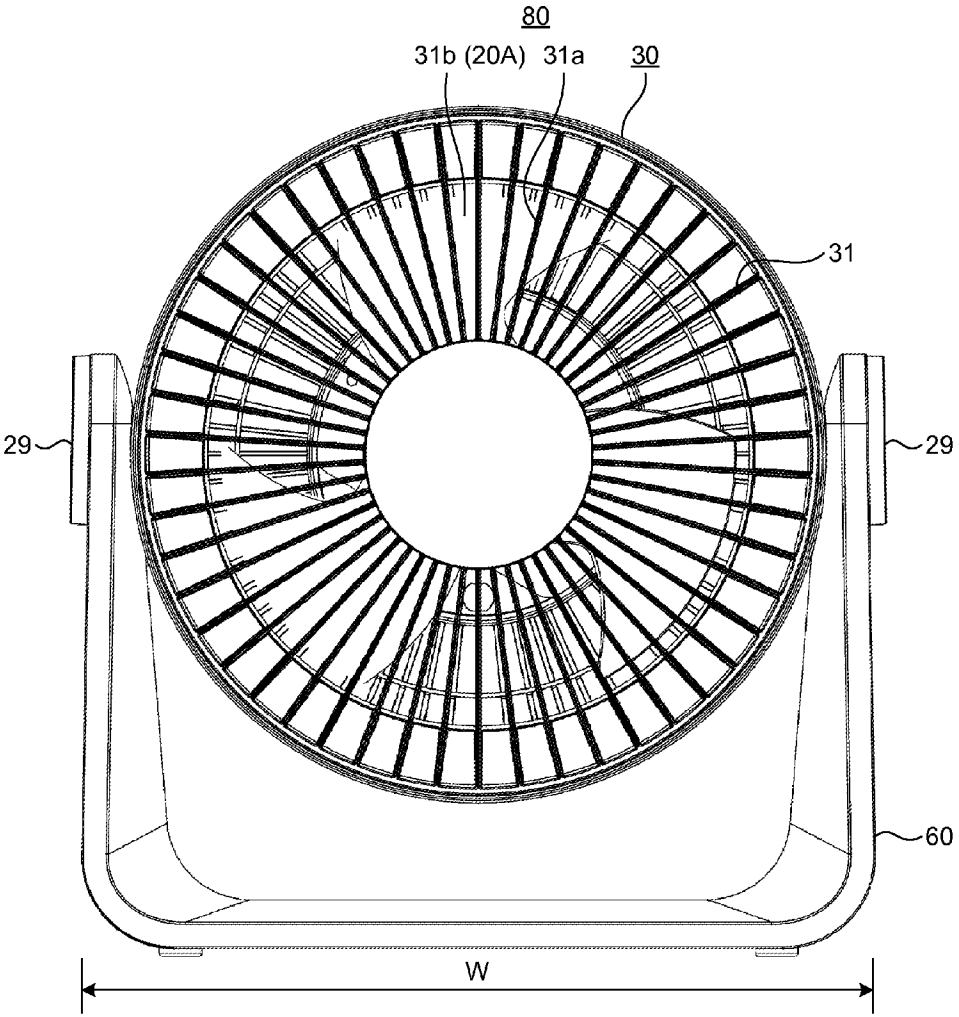
FIG. 1 is an illustration of a circulator according to an embodiment of the present invention as viewed from the front.
Figure 2:
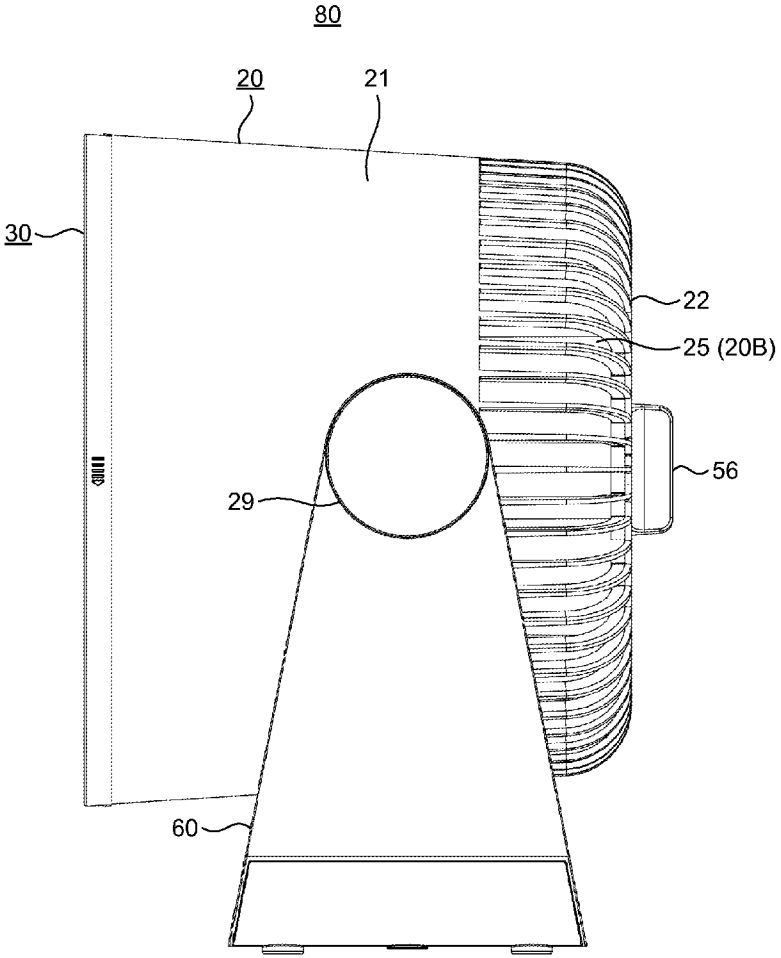
FIG. 2 is an illustration of the circulator according to the embodiment as viewed from a side.
Figure 3:
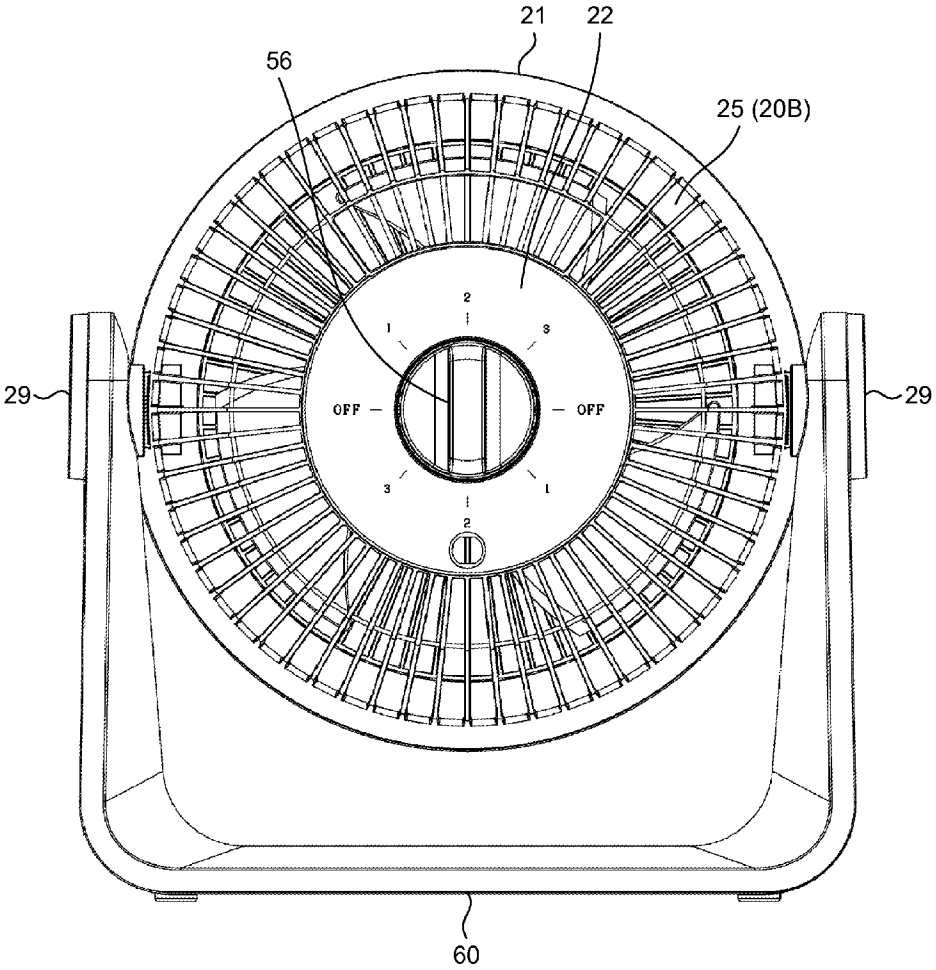
FIG. 3 is an illustration of the circulator according to the embodiment as viewed from the back.
Figure 4:
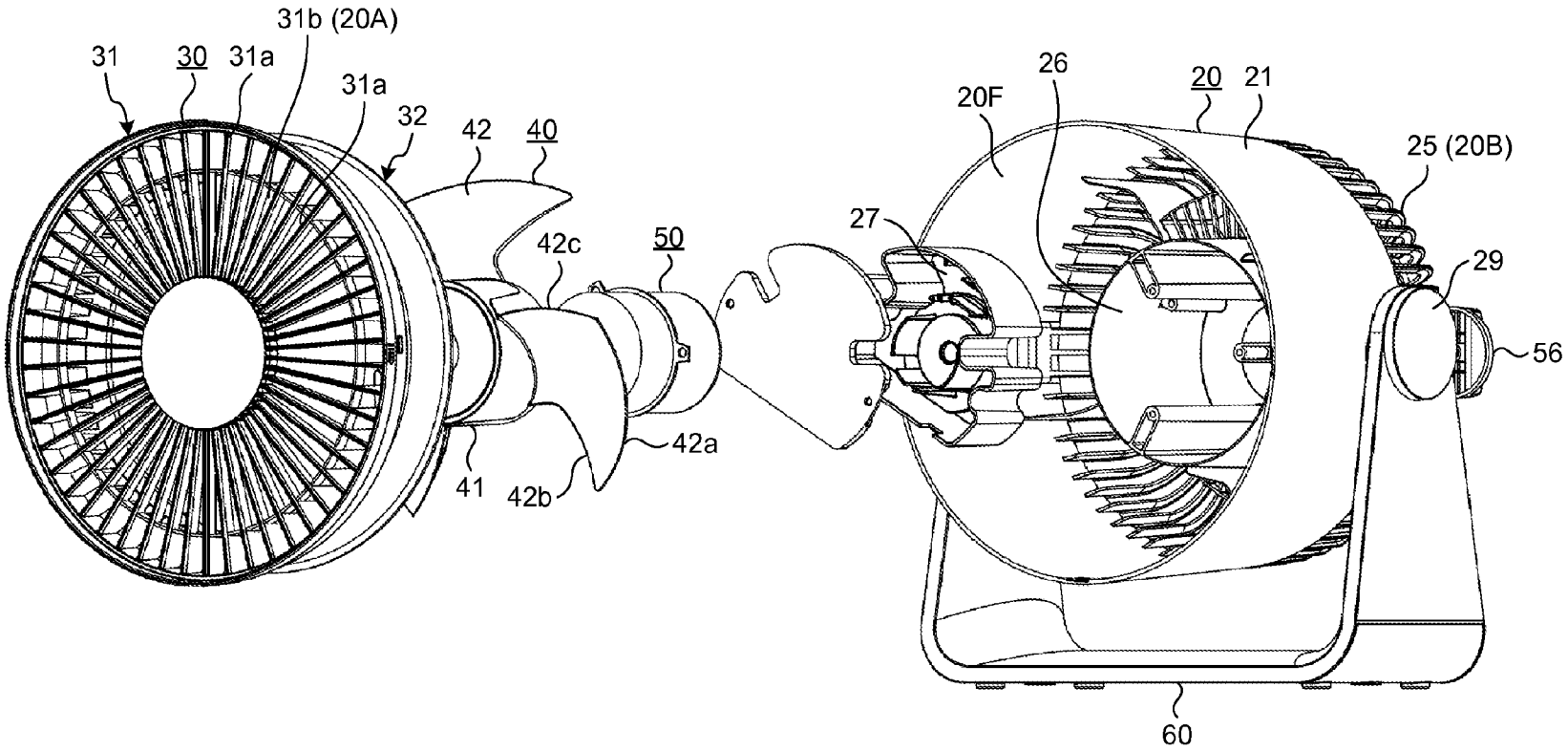
FIG. 4 is an exploded perspective view of the circulator according to the embodiment.
Figure 5:
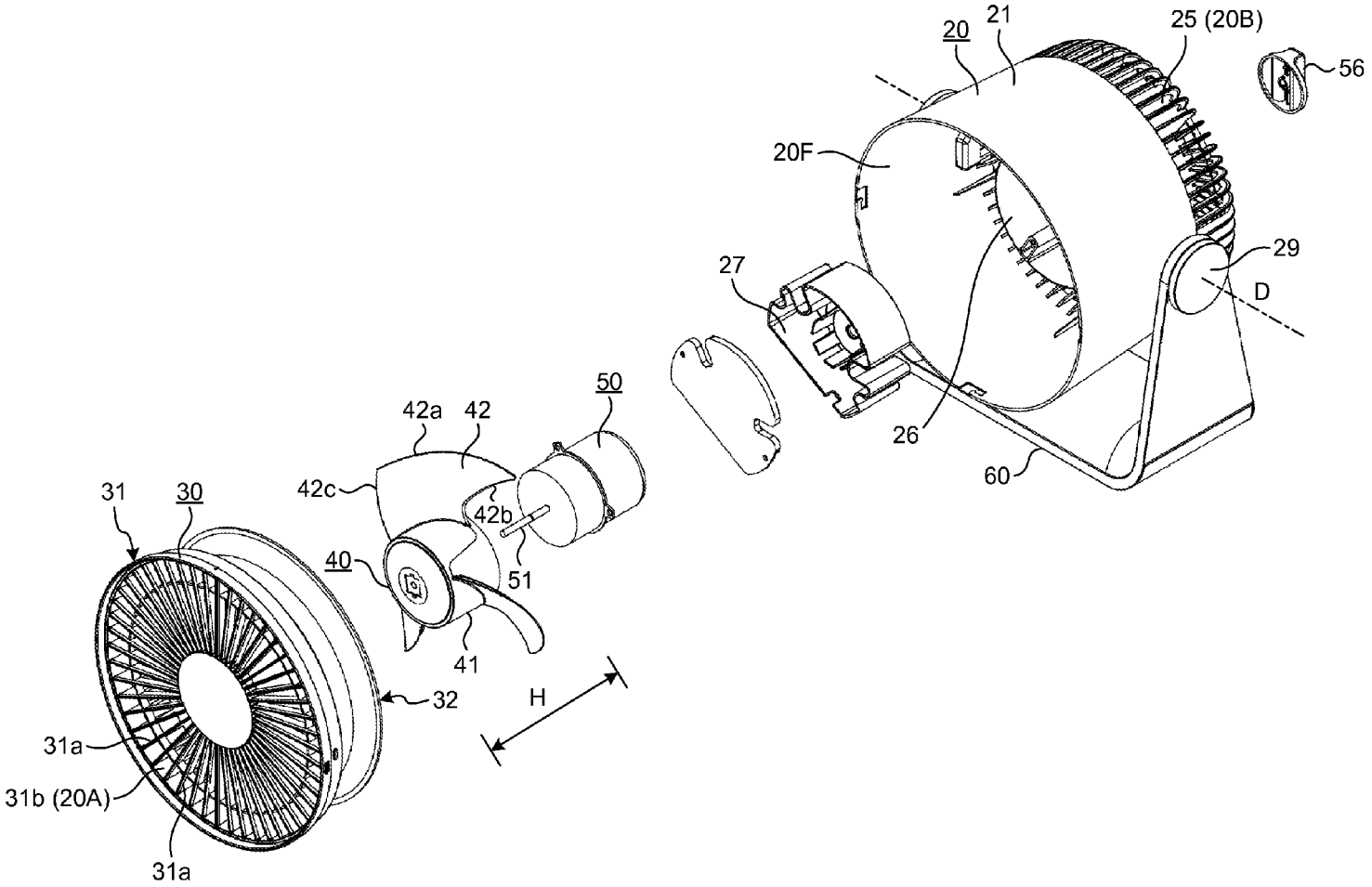
FIG. 5 is an exploded perspective view of the circulator according to the embodiment as viewed from a direction different from that in FIG. 4.
Figure 6:
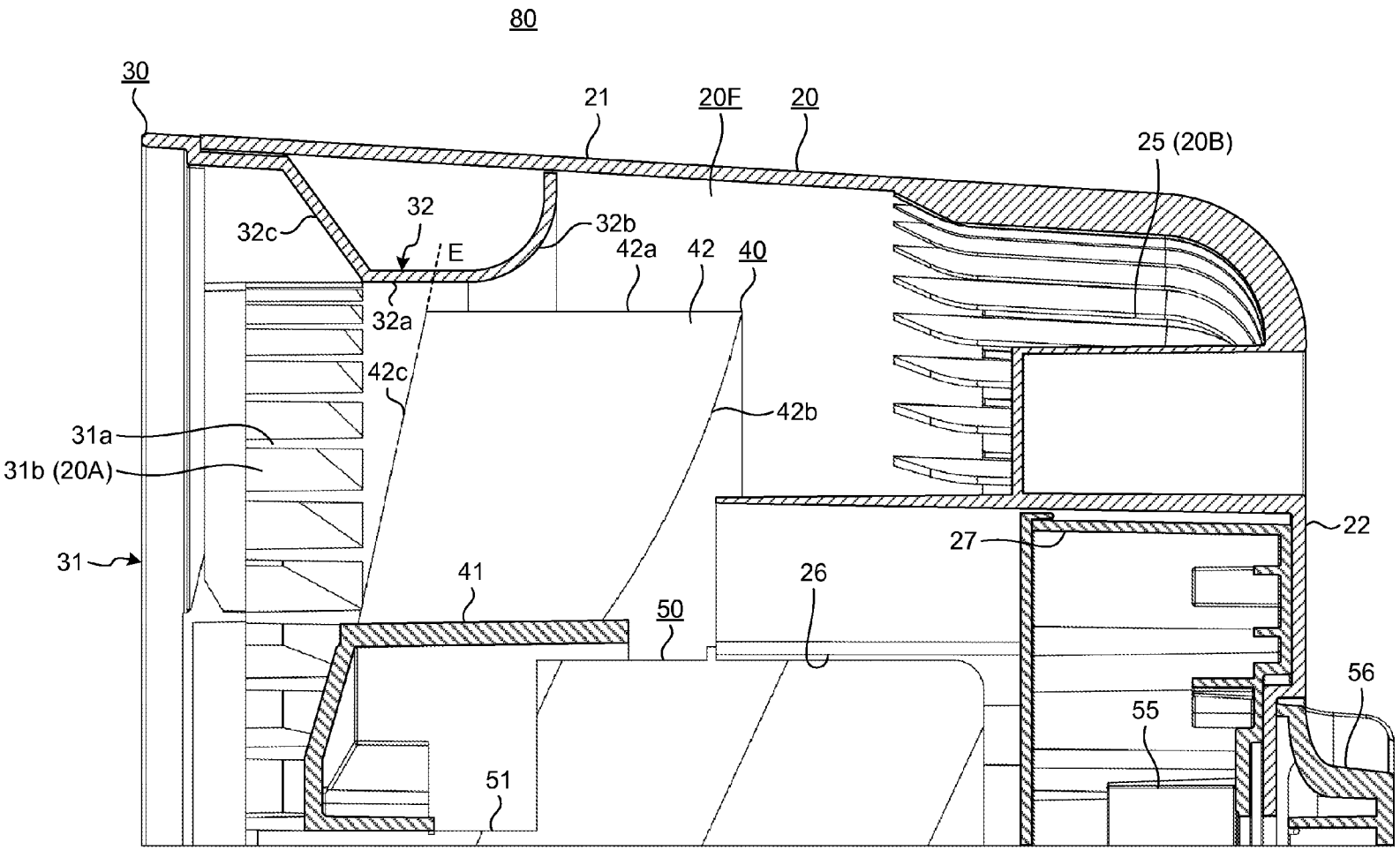
FIG. 6 is a vertical cross-sectional view of the circulator according to the embodiment taken along a surface in an axial-line direction.
Figure 7:
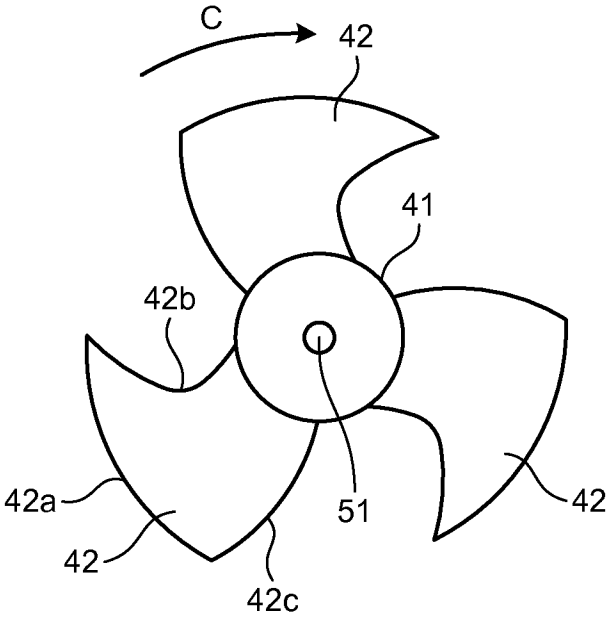
FIG. 7 is a front view of an impeller.
Figure 8:
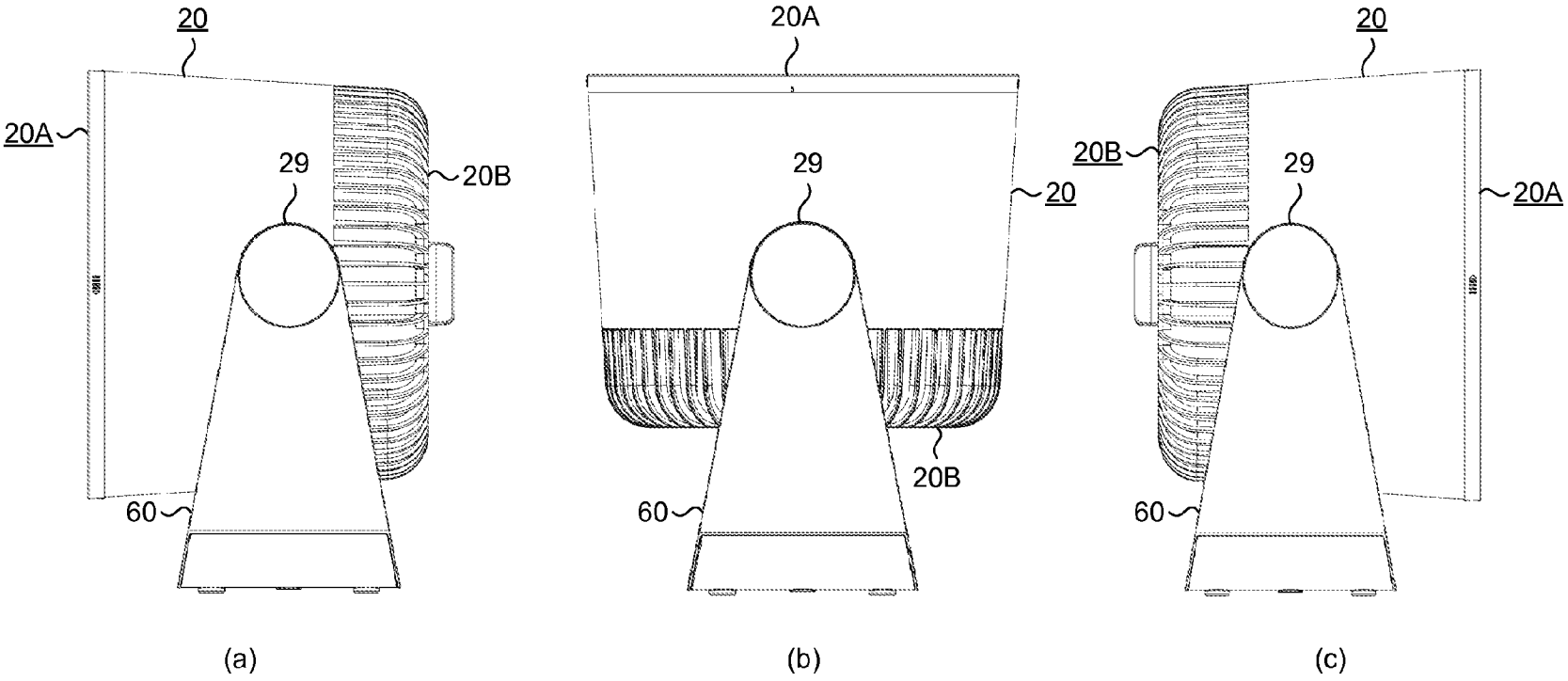
FIG. 8 is a figure showing a state where a main body changes the direction of a discharge port.

FIG. 1 is an illustration of a circulator according to an embodiment of the present invention as viewed from the front. FIG. 2 is an illustration of the circulator as viewed from a side thereof. FIG. 3 is an illustration of the circulator as viewed from the back thereof. FIG. 4 is an exploded perspective view of the circulator. FIG. 5 is an exploded perspective view of the circulator as viewed from a direction different from that in FIG. 4. FIG. 6 is a vertical cross-sectional view of the circulator taken along a surface in an axial-line direction. FIG. 7 is a front view of an impeller. FIG. 8 is a figure showing a state where a main body changes the direction of a discharge port. The cross-sectional view of FIG. 6 depicts only a half of the circulator on one side with respect to the center line.

A circulator 80 includes a substantially bottomed cylinder-shaped main body 20 forming a housing and being substantially hollow in the inside of the main body 20. That is, the main body 20 is constituted by a cylinder-shaped cylindrical portion 21 and a bottom portion 22 that closes a rear end of the cylindrical portion 21. One side of the main body 20, which has an opening, is the front part, and the other side of the main body 20, which has the bottom portion 22, is the rear part. The opening at the front part of the main body 20 is closed by a grill unit 30. Both the main body 20 and the grill unit 30 are formed from a resin material.

A number of slits 25 are formed at the rear part of the main body 20 to form a suction port 20B. A rotary switch 55 is provided at the center of the bottom portion 22 of the main body 20 (FIG. 6). The slits 25 extend radially from a periphery of a knob 56 of the rotary switch 55 and extend from an outer peripheral portion of the bottom portion 22 to the cylindrical portion 21, and further extend in its axial-line direction along the cylindrical portion 21 to make the cylindrical portion 21 to be opened, and are open. That is, a plurality of slits 25 are formed into a substantially L shape in the bottom portion 22 of the main body 20 and a corner of the cylindrical portion 21 in such a manner that the slits 25 range over a whole circumference of the rear part of the main body 20. In this way, the suction port 20B is formed striding across the bottom portion 22 and the cylindrical portion 21, and accordingly the size of the suction port 20B is sufficiently large.

The grill unit 30 is constituted by a disk-shaped net grill 31 that covers the opening at the front part of the main body 20 and an orifice 32 that extends from an outer peripheral edge of the grill 31 to the inside of the main body 20. A central portion of the grill 31 is covered by a small disk. A plurality of ribs 31*a* extending radially from the small disk are formed over the entire surface of the grill 31. A slit 31*b* is formed between the ribs 31*a*. That is, the grill 31 is formed like a net on which the slits 31*b* are formed on the entire surface except the central portion. A plurality of slits 31*b* constitute a discharge port 20A. In this manner, the main body 20 has a structure in which the discharge port 20A is provided at a front end of the main body 20 (one end of the cylinder) and the suction port 20B is provided at a rear end of the main body 20 (the other end of the cylinder).

A straight air passage 20F extending from the suction port 20B toward the discharge port 20A is formed in the inside of the main body 20 (FIG. 6). An impeller 40 and a motor 50 that rotates the impeller 40 are disposed in the air passage 20F. The impeller 40 is driven by the motor 50 to discharge air sucked through the suction port 20B out of the discharge port 20A.

As shown in FIG. 6, the orifice 32 is provided in the grill unit 30 along the grill 31 for the purpose of locally narrowing (throttling) a part of the air passage 20F (which is close to the discharge port 20A in the front part) at a specific point. As described above, the orifice 32 is formed integrally with the grill 31, and is fitted into the opening of the main body 20 when the grill unit 30 is attached to the main body 20. The orifice 32 is arranged in order that its curved surface protrudes annularly from an inner surface of the main body 20 in a part of the air passage 20F near the discharge port 20A to narrow this part of the air passage 20F.

More specifically, as shown in FIG. 6, the orifice 32 is formed of a straight cylindrical portion 32*a* that is provided in its top by which the air passage 20F is narrowed farthest, and extends straightly in the axial-line direction, a bell-mouthed curved portion 32*b* that is provided on a side of the suction port 20B of the straight cylindrical portion 32*a*, and a conical expanding portion 32*c* that is provided on a side of the discharge port 20A of the straight cylindrical portion 32*a*. That is, an air flow through the air passage 20F from the suction port 20B toward the discharge port 20A is first throttled and compressed by the curved portion 32*b* to increase the air pressure. The increased-pressure air flow passes over the straight cylindrical portion 32*a*, and then expands again by the expanding portion 32*c* to decrease the air pressure. In the circulator 80 according to the present embodiment, the impeller 40 is provided in a part of the air passage 20F having been narrowed by the orifice 32, and thereby a high-speed air flow can be effectively formed. Accordingly, it is possible to realize a circulator with low noise and a large amount of the blown air.

The impeller 40 is a propeller fan having a shape shown in FIG. 7 and is generally referred to as EXTRA FAN™. The impeller 40 includes a hub 41 mounted on a drive shaft 51 of the motor 50 and three substantially triangle-shaped triangular blades 42 extending outward in the radial direction from the hub 41. Each of the triangular blades 42 is formed into an inclined shape in its entirety in order that an angular portion formed between an outer peripheral end 42*a* and a front-edge end 42*b* (an angular portion directed in the rotational direction) extends lengthwise in the rotational direction indicated by an arrow C in FIG. 7, and the angular-portion side is tilted to the suction side (the side of the suction port 20B). Because of this shape of the triangular blade 42, the circulator 80 is characterized in that it is able to discharge a large amount of air at a low noise level. While the impeller 40 includes the three triangular blades 42 in the present embodiment, the impeller 40 may include four or more blades.

The impeller 40 as described above is arranged at an appropriate position in the air passage 20F in such a manner that a part of the impeller 40 overlaps with the orifice 32 in the axial direction. This appropriate position is a position where a side of the outer peripheral end 42*a* of the triangular blade 42 partially overlaps with the orifice 32, and is brought near the side of the suction port 20B. More specifically, the impeller 40 is located at a position where a predetermined gap is maintained between the outer peripheral end 42*a* of the triangular blade 42 and the straight cylindrical portion 32*a*, and an extended line of a rear-edge end 42*c* on the side of the discharge port 20A in the outer peripheral direction (indicated by a broken line E in FIG. 6) intersects the straight cylindrical portion 32*a*. As described above, by using the EXTRA FAN™, the circulator 80 can achieve discharge of a large amount of air at a low noise level, but because a distal end of the triangular blade 42 extends lengthwise, there is a problem that the blade thickness in the rotational axis direction (indicated by H in FIG. 5) increases.

Specifically, the cylindrical portion 21 of the main body 20 has a tapered shape with a larger diameter on the side of the discharge port 20A and a smaller diameter on the side of the suction port 20B. A support shaft 29 is provided on an outer peripheral surface of the rear part of the main body 20 at a position close to the suction port 20B. As indicated by a dashed-dotted line D in FIG. 5, the support shaft 29 is provided standing in a direction perpendicular to the center axis of the main body 20. A leg portion 60 formed into a substantially U shape pivotally supports the support shaft 29 at its both distal ends in such a manner that the shaft 29 can be rotated. Due to the tapered shape of the main body 20, its rear part has a smaller diameter than that at the support position, and therefore does not interfere with the leg portion 60, so that as shown in FIGS. 8, the main body 20 rotates at an angle of 180° or more about the support shaft 29 as a rotational axis.

Furthermore, in the circulator 80 according to the present embodiment, its outer-peripheral cylindrical shape is tapered, and the leg portion 60 supports the smaller-diameter rear-part side of the main body 20. Therefore, the width of the substantially U-shaped leg portion 60 (indicated by W in FIG. 1) can be smaller, and the device can be made compact. Further, the main body 20 rotates at an angle of 180° or more relative to the leg portion 60. Therefore, the discharge port 20A can be directed not only to the front (FIG. 8(*a*)), but also vertically upward (FIG. 8(*b*)) and just to the rear (FIG. 8(*c*)). A ratchet structure (not shown) for fixing the main body 20 at a predetermined angle is provided in the inside of the support shaft 29.

A motor housing unit 26 that houses the motor 50 and an electrical-component housing unit 27 that houses electrical components (not shown) for driving the motor 50 are provided at the center of the bottom portion 22 of the main body 20 (FIGS. 4 and 6). Furthermore, the rotary switch 55 is provided at the rear of the electrical-component housing unit 27. The knob 56 protrudes from the rotary switch 55 at the center of the rear part of the main body 20, and by rotating the knob 56, the rotary switch 55 changes the rotational speed of the motor 50 to change the discharged air amount and the air-flow speed. In this way, the knob 56 of the rotary switch 55 is arranged at the center of the suction port 20B while matching with the axial center of the main body 20, thereby improving the designability of the device (FIG. 3). The motor 50 (the motor housing unit 26), the electrical-component housing unit 27, and the rotary switch 55 are arranged in line on the center axial line of the main body 20, thereby enhancing the concentration of electrical components and providing a simple structure in which, for example, wiring of electric wires does not have to be disposed in other areas.

As described above, the circulator 80 according to the present embodiment includes the main body 20 forming the air passage 20F, the impeller 40, and the motor 50. The main body 20 is cylindrical, in which the discharge port 20A is formed at one end thereof, the suction port 20B is formed at the other end thereof, and the air passage 20F that extends straightly from the suction port 20B to the discharge port 20A is formed in the inside thereof. The orifice 32 is provided annularly along the inner periphery of the air passage 20F to locally narrow the air passage 20F at a specific point. The impeller 40 is disposed in a part of the air passage 20F having been narrowed by the orifice 32. The motor 50 is connected to the impeller 40 to rotate the impeller 40 so as to discharge air from the discharge port 20A, the air having been sucked through the suction port 20B.

Particularly, the orifice 32 that locally narrows the air passage 20F at a specific point is provided in the air passage 20F, and the impeller 40 is provided in a part of the air passage 20F having been narrowed by the orifice 32. Therefore, a high-speed air flow can be effectively generated. Accordingly, the circulator 80 can discharge a large amount of air at a low noise level.

Furthermore, because the main body 20 is constituted by a cylindrical body, and the impeller 40 and the motor 50 are located in the cylindrical body, even in a device configuration in which the impeller 40 having a large blade thickness in the rotational axis direction and the motor 50 connected to the impeller 40 results in large in length the rotational axis direction, such impeller and motor can be easily housed in the main body 20 in such a way that they are not viewed from the outside, thereby improving the designability of the device. Further, the air passage 20F is formed in the cylindrical body to generate an air flow along the cylindrical body so that the discharged air flow is enhanced in straightness, thereby further increasing the outreach distance of the blown air.

Furthermore, the grill 31 and the orifice 32 are formed integrally with each other and are manufactured from resin to achieve reduction in the number of components and facilitation of the attachment of the grill 31 and the orifice 32 to the main body 20. Further, matching with the grill 31 in which the net-like discharge port 20A is formed in a part other than the central portion, the motor housing unit 26 and the electrical-component housing unit 27 are provided at the central portion of the suction port 20B in such a manner that the units 26 and 27 overlap with each other in the axial direction. Therefore, the space around the center axial line, which can not be used as an air passage due to the existence of the motor 50, is efficiently utilized, thereby enhancing the concentration of electrical components including the rotary switch 55.

As described above, the grill 31 and the orifice 32 are formed integrally with each other in the grill unit 30. When the grill unit 30 is attached to the main body 20, the orifice 32 is fitted in the main body 20 with sliding to the inner side of the opening of the main body 20 to serve as a guide. Meanwhile, the outer peripheral end of the grill 31 projects to the extent that it comes in butt-contact with the edge of the opening of the main body 20. Therefore, just by pressing the orifice 32 into the opening of the main body 20, the grill unit 30 can be pressed and stopped at an appropriate position, and can be easily attached.

The circulator 80 according to the present embodiment is provided with the EXTRA FAN™ as the impeller 40. While it is desirable that the circulator is provided with the EXTRA FAN™ in order to achieve a large amount of air at a low noise level in addition to the effects of the orifice 32, the present invention is not limited thereto.

INDUSTRIAL APPLICABILITY

As described above, the circulator according to the present invention is suitably applied to a desktop or floor-placed circulator, and is particularly suitably applied a circulator required to have compactness, low noise and a large amount of air.

REFERENCE SIGNS LIST

20 main body
20A discharge port
20B suction port
20F air passage
21 cylindrical portion
22 bottom portion
25 slit
26 motor housing unit
27 electrical-component housing unit
29 support shaft
30 grill unit
31 grill
31*a* rib
31*b* slit
32 orifice
32*a* straight cylindrical portion
32*b* curved portion
32*c* expanding portion
40 impeller
41 hub

42 triangular blade
42*a* outer peripheral end of triangular blade
42*b* front-edge end of triangular blade
42*c* rear-edge end of triangular blade
50 motor
51 drive shaft
55 rotary switch
56 knob of rotary switch
60 leg portion
80 circulator

The invention claimed is:

1. A circulator comprising:

a main body that is cylindrical, in which a discharge port is formed at one end thereof, a suction port is formed at the other end thereof, and an air passage extending from the suction port to the discharge port is formed in the inside thereof;

a grill unit having a wall facing radially outward, the wall being provided annularly along an inner periphery of the air passage and locally narrowing the air passage, and the wall including a cylinder-shaped straight cylindrical portion that is provided at a part of the wall where the air passage is narrowed farthest and that extends straightly in an axial-line direction, a bell-mouthed curved portion that is provided on a side of the suction port of the straight cylindrical portion, and a conical tapered portion that is provided on a side of the discharge port of the straight cylindrical portion;

an impeller that is located in a part of the air passage having been narrowed by the wall;

a motor that is connected to the impeller and rotates the impeller to discharge air having been sucked from the suction port out of the discharge port; and an electrical-component housing unit, wherein the main body includes the motor in a central portion, the electrical-component housing unit is disposed in the main body while being situated on a center axial line of the main body and behind the motor so as to be farther from the discharge port than the motor, and the grill unit includes a grill provided to cover the discharge port, and is configured so that when the grill unit is attached to the main body, the wall is fitted in the main body by sliding to an inner side of an opening of the main body serving as a guide so that a protrusion of the wall extending from the conical tapered portion toward the discharge port abuts against an inner surface of the main body, and an outer peripheral end of the grill comes in butt-contact with an edge of the opening on a side of the discharge port of the main body in the axial-line direction.

2. The circulator according to claim 1, wherein the impeller is a propeller fan including a hub that is rotated and driven by the motor and a plurality of substantially triangle-shaped triangular blades that extend outward in a radial direction from the hub and are inclined in such a manner that an angular-portion side of the blade directed to a rotational direction is tilted toward a sucking side to blow air in a rotational axis direction, and the impeller is disposed in a position where a predetermined gap is maintained between an outer peripheral end of the triangular blade and the straight cylindrical portion, and a radially-extended line of a rear-edge end of the triangular blade intersects the straight cylindrical portion.

3. The circulator according to claim 1, wherein the wall and the grill are formed integrally with each other from resin.

4. The circulator according to claim 1, wherein the main body has a tapered cylindrical shape with a larger diameter on a side of the discharge port and a smaller diameter on a side of the suction port, and the circulator further comprises a leg portion that supports the main body by pivotally supporting a support shaft provided on an outer peripheral surface of the main body at a position close to the suction port.

5. The circulator according to claim 4, wherein the support shaft extends in a direction perpendicular to a center axis of the main body, and the main body rotates in the range of at least 180° about the support shaft as a rotational axis.

6. The circulator according to claim 1, wherein a rotary switch that adjusts an air amount is provided in a rear end of a central portion of the suction port with an axial center of the rotary switch matching with that of the motor.

7. The circulator according to claim 1, wherein the discharge port has a diameter and the suction port has a diameter, and the diameter of the discharge port is greater than the diameter of the suction port.

8. The circulator according to claim 1, wherein the wall is provided closer to the discharge port than to the suction port.

9. The circulator according to claim 1, wherein the outer peripheral end of the grill radially projects to make the butt-contact with the edge of the opening of the main body thereby to achieve positioning of the grill unit.

* * * * *